United States Patent [19]

Eberhardt

[11] Patent Number: 4,907,654

[45] Date of Patent: Mar. 13, 1990

[54] WATER DRIVEN FAN SYSTEM FOR FIREFIGHTING

[75] Inventor: H. Alfred Eberhardt, Paoli, Pa.

[73] Assignee: Hale Fire Pump Company, Conshohocken, Pa.

[21] Appl. No.: 242,494

[22] Filed: Sep. 12, 1988

[51] Int. Cl.[4] ..... A62C 39/00

[52] U.S. Cl. ..... 169/70; 239/383; 169/15

[58] Field of Search ..... 169/70, 54, 91, 15; 239/380, 381, 382, 383, 14.2, 240, 241, 242, 205, 446

[56] References Cited

U.S. PATENT DOCUMENTS 3,780,812 12/1973 Lambert ..... 169/15

4,427,074 1/1984 Wollin ..... 169/70

*Primary Examiner*—Joseph F. Peters, Jr.

*Assistant Examiner*—Anne Sartelle

*Attorney, Agent, or Firm*—Frank A. Follmer

[57] ABSTRACT

A fan system for use in firefighting applications employing positive pressure ventilation includes a lightweight portable fan having a water-powered turbine as its driver. A flow control valve is operable to set the system to operate in a plurality of modes including a mode wherein an air stream and a water mist can be directed toward the fire.

9 Claims, 5 Drawing Sheets

WATER DRIVEN FAN SYSTEM FOR FIREFIGHTING

BACKGROUND AND SUMMARY OF THE INVENTION

This invention relates generally to the field of fans and, more particularly, to portable fans of the type used in firefighting applications by the use of positive pressure ventilation to help the firefighter both clear smoke from his path and fight the fire.

Positive pressure ventilation is a firefighting technique for removing heat and smoke from a fire area within a building or the like wherein clear air is directed into the building to produce a positive pressure therein by using fans, or blowers. This technique is becoming well known in the art and involves, by way of example, positioning the fan in or near a ground floor doorway of a house having a fire therein and breaking open a window at a desirable location on the other side of the fire, such as on the second floor. The fan is operated to blow air into the house to create what is called a "positive pressure" inside the house (typically a couple inches of water pressure) which pushes the smoke out. By the proper selection of the location of the exit opening and the direction of air flow from the fan, the clear air will flow from the doorway across the fire area to move smoke away from the fire area so that it rises up and out of the house and away from the firefighters through the second floor opening provided.

There are two types of blowers in use today for this type of firefighting application, namely, electric blowers and gasoline-powered blowers. Electric blowers have the disadvantage that for portable construction the higher horsepower motors are two heavy and cannot provide the high power requirements for many applications. Also, electric blowers normally are limited in speed to 3600 RPM. Gasoline-powered blowers have the disadvantages that the are noisy, heavy, and introduce harmful carbon monoxide inside the structure where the fire is located.

It is the general object of the invention to provide a fan system of the indicated type which obviates the problems of the electric and gasoline-powered blowers in use today by providing a clean operation and by providing sufficient power with light weight and portability for any firefighting application.

Another object of the invention is to provide a fan system of the indicated type wherein the fan uses a water powered turbine as its driver.

Another object of the invention is to provide a portable fan system of the indicated type which is capable of ventilating smoke and fumes and cooling a building having a fire therein.

Another object of the invention is to provide a fan system of the indicated type wherein the fan is constructed so that it is easy to stow, is portable and is easy to set up and use.

Another object of the invention is to provide a fan system of the indicated type which can act like a mobile sprinkler system by delivering a water spray or mist onto the fire area to provide a cooling air stream.

Another object of the invention is to provide a fan system of the indicated type including a flow control means for setting the system to operate in a plurality of modes, including a mode wherein a clear air stream is directed toward the fire, a mode wherein an air stream and a mist is directed toward the fire, and a mode wherein a straight fire stream is directed toward the fire.

One of the important advantages of the system in accordance with the invention is that by using a water powered turbine as the driver of the fan, it is possible to provide an extremely small and compact power source for the fan. For example, a 20 horsepower aluminum water turbine weighs only about 20 pounds whereas a 20 horsepower gasoline engine weighs over 100 pounds. Thus, the device in accordance with the invention can be made portable so that it can be set up quickly and easily and so that the firefighter can more easily carry the fan with him as he advances towards the fire. Also, the high speed fan design in accordance with the invention is made to provide a very high volume of flow with a very light and compact construction by using a lightweight aluminum housing and strong lightweight fan blades. Thus, the device can be designed to be sufficiently portable so that one man can carry it and, in use, there is a valve attached so that whenever the firefighter reaches an area of the fire where the fumes and smoke have been evacuated he can open a valve and direct a stream of water directly onto the fire using the water supply line that was driving the fan.

As to other prior art, there is in use a smoke and fume extractor especially developed to extract fumes or to ventilate rooms subject to explosion dangers. This device utilizes a vacuum fan driven by a water turbine to pull smoke and fumes from a danger area.

DETAILED DESCRIPTION OF THE PREFERRED EMBODIMENT

Figures 1, 3:
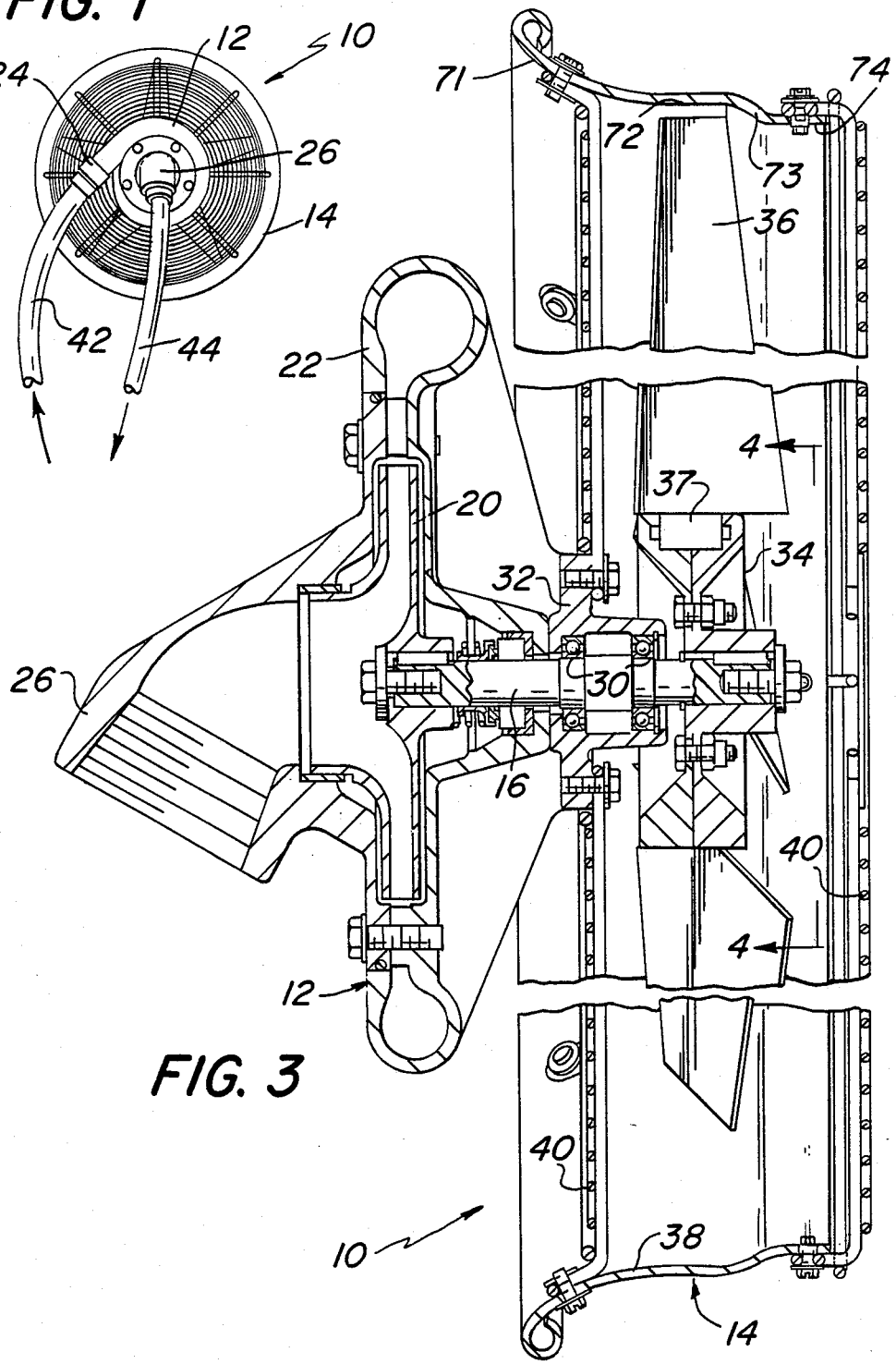
FIG. 1 is a rear elevation view of a water driven fan for use in the fan system in accordance with this invention.
FIG. 3 is a sectional view taken on line 3—3 of FIG. 2.
Figure 2:
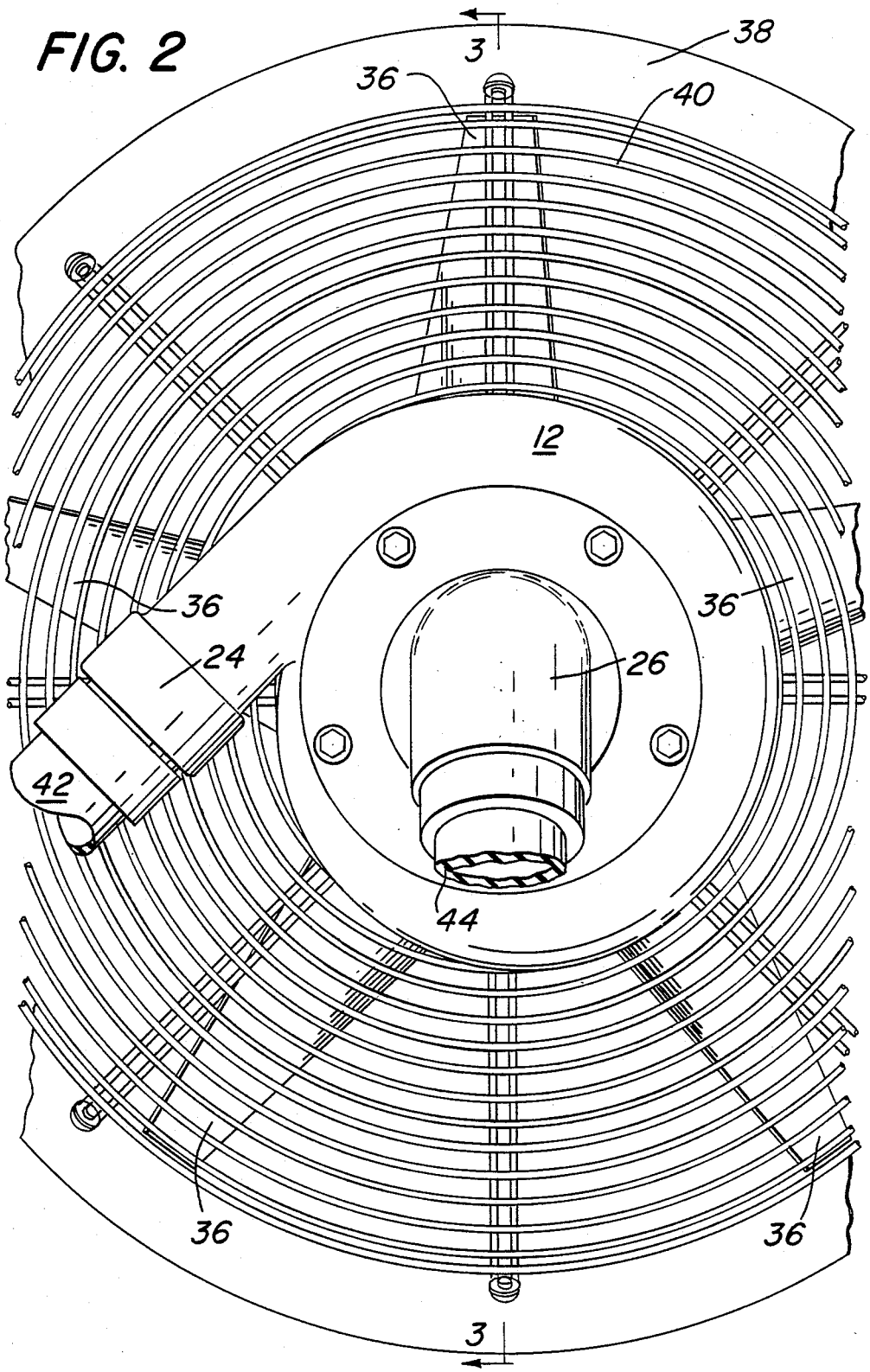
FIG. 2 is an enlarged view of the water driven fan shown in FIG. 1.
Figure 4:
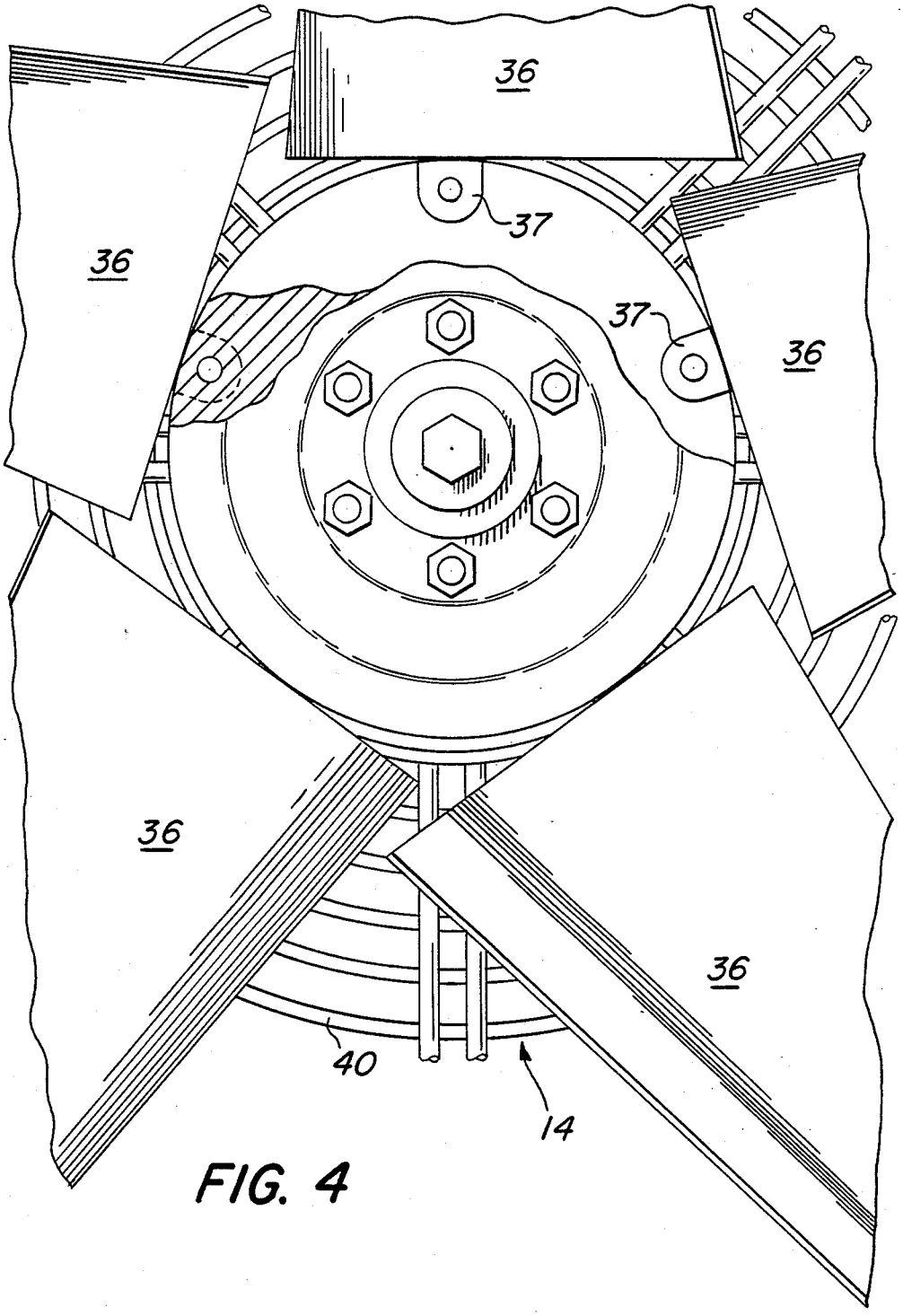
FIG. 4 is a sectional view taken on line 4—4 of FIG. 3.
Figure 5:
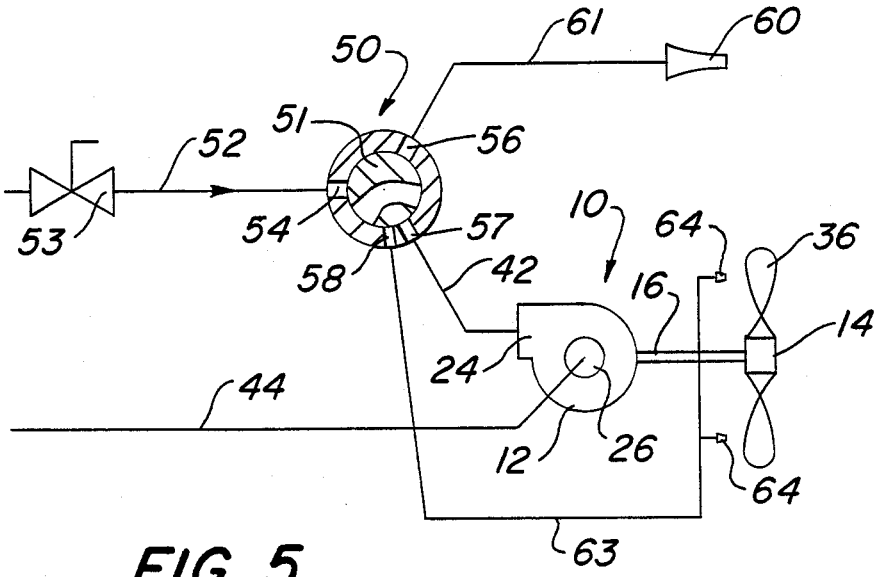
FIGS. 5–8 are partially schematic showings of a water driven fan system in accordance with the invention for use in the fighting of fires by positive pressure ventilation.

Referring to FIGS. 1–4, the water driven fan means shown therein is indicated generally at 10 and comprises a water powered turbine 12 constructed and arranged to drive a fan 14 by way of a common shaft 16. Turbine 12 is of a conventional construction and comprises a runner 20 mounted on and keyed to one end of shaft 16 to rotate within the interior of the turbine body 22, which is provided with an inlet 24 and an outlet 26 for directing the water into and out of body 22. Shaft 16 is rotatably supported at a medial portion by a pair of bearings 30 contained in housing 32. Fan 14 comprises a hub or rotor 34 mounted on and keyed to the other end of shaft 16 by an arrangement shown in FIG. 3. The arrangement using the common shaft 16 eliminates the cost and other problems of providing a coupling between the turbine 12 and the fan 14. Hub 34 has five variable pitch fan blades 36 mounted thereon at their base 37 so as to extend radially outwardly from the axis of shaft 16 on an angle of about 35° as shown in the Drawings. The fan blades 36 are contained within a shroud 38 and are enclosed by a pair of fan guards 40 formed from an open wire-like configuration as is shown in the Drawings.

As shown in FIG. 3, shroud 38 has a special shape whereby the air flow entering the fan 14 is smoothly accelerated and the air flow leaving the fan 14 is subjected to further acceleration to improve the control of the direction of the air flow. To this end, in the direction of air flow through fan 14, the entry portion 71 of shroud 38 is formed to converge gradually, the medial portion 72 of shroud 38 is generally cylindrical, and the exit portion 73 of shroud 38,starting from the location where the air leaves the edges of the fan blades 36 on their outer diameter, converges in a nozzle shape. The diameter of exit portion 73 at its downstream end 74 is equal to or less than the outer diameter of the blades 36 as is shown in FIG. 3. By this arrangement, the air is smoothly accelerated as it comes into the fan 14 and it is subject to further acceleration by the nozzle shape for improving the directional control of the air flow. This acceleration of the air flow reduces some of the vortexes in the air flow through fan 14 and provides a smooth flow of the air delivered from the fan 14 so that the fan 14 becomes more directional. Accordingly, the firefighter can direct the air flow more accurately toward a window, a door, or whatever, as is appropriate for the positive pressure ventilation procedure being utilized.

A typical fan means 10 in accordance with the invention comprises a 20 horsepower water turbine 12 operating at 1750–2000 RPM with a fan 14 having a 30 inch diameter.

Fan means 10 is made of a lightweight construction. To this end, turbine 12 is made of lightweight cast aluminum, shroud 38 is made of a lightweight spun aluminum, and fan blades 36 are made of a strong lightweight material including "Kevlar" which is an aramid fiber made by DuPont Company.

In the operation of the water driven fan means 10, water under pressure is supplied through a supply line 42 to the inlet 24 of turbine 12 which directs the water to cause rotation of runner 20 and the shaft 16 keyed thereto, with the water being discharged from turbine 12 through outlet 26. The operation of water driven turbine 12 to drive shaft 16 is entirely conventional. Fan 14 is driven by the rotating common drive shaft 16 to blow air under positive pressure by the action of rotating blades 36 which direct the air along the axis of shaft 16.

Referring to FIGS. 5–8, there is shown the water driven fan system in accordance with the invention as it is hooked up for using positive pressure ventilation for the fighting of fires. The system includes a flow control valve 50 movable between a first flow control position shown in FIG. 5 (the OFF position), a second flow control position shown in FIG. 6 (the FAN position), a third flow control position shown in FIG. 7 (the FAN and MIST position), and a fourth flow control position shown in FIG. 8 (the NOZZLE position). A water supply line 52 is connected from a pressurized supply source to an inlet port 54 of valve 50. Supply line 52 has a source shut-off valve 53 connected therein to control flow therethrough. Typically, the pressurized supply source is a fire pump located on a fire truck and having its suction connected to a tank of water on the fire truck. Valve 50 is provided with three outlet ports 56, 57 and 58 and a rotatable valve member 51 containing a flow passage as is shown in the Drawings. Outlet port 56 is connected to a fire hose nozzle 60 by way of a flow line 61. Outlet port 57 is connected to the inlet 24 of turbine 12 by line 42 as described above. Outlet port 58 is connected to a plurality of small mist nozzles 64 by way of a flow line 63. Mist nozzles 64 are constructed to discharge small water spray at a location adjacent the upstream side of the fan blades 36. The outlet 26 of turbine 12 is connected back to the water supply source (ie., the water tank on the fire truck) by way of flow line 44. Alternatively, flow line 42 may be connected to dump the water into a sewer if this is more convenient.

As is apparent from a consideration of FIGS. 5–8, the fan system of the invention can be converted between an OFF position and three different operating positions. In the OFF position shown in FIG. 5, valve member 51 is positioned to block flow from the inlet port 54 to any of the outlet ports 56, 57 or 58, whereby there will be no flow of water through any of the flow lines 61, 42 or 63 connected to valve 50.

Figure 6:
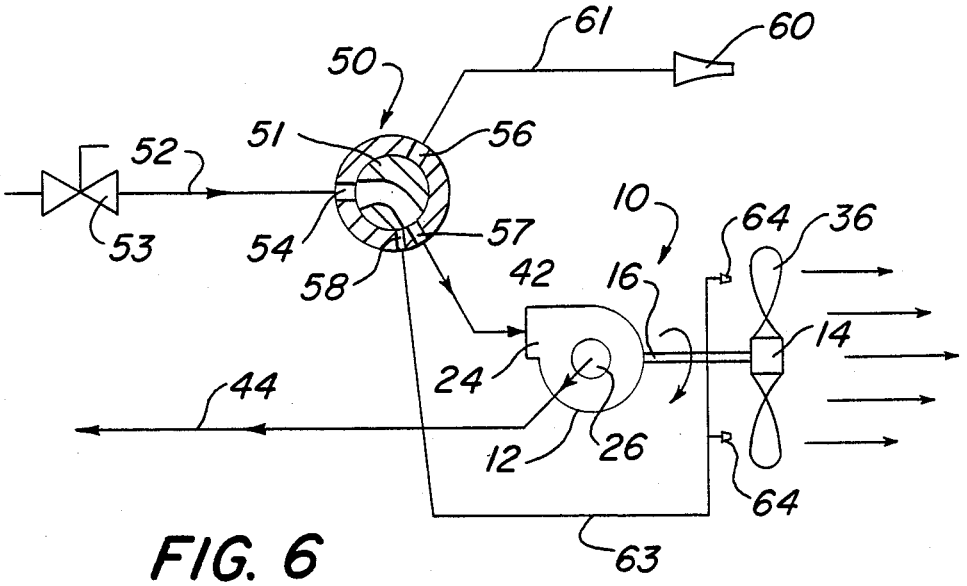

In the FAN position shown in FIG. 6, valve member 51 is positioned to provide flow communication between inlet port 54 and outlet port 57. In this operating position, the source shut-off valve 53, when it is moved to an open position, allows water under pressure to be delivered through line 52, flow control valve 50 and line 42 to the inlet of turbine 12 which causes the runner 20 to rotate and causes operation of fan 14 through the common shaft 16 whereby fan blades 36 direct an air stream in the direction of the arrowed lines shown in FIG. 6. By the proper positioning of fan 14, the firefighters can fight a fire by positive pressure ventilation by directing an air stream into a building and providing an outlet on the other side of the fire so that smoke is discharged from the building resulting in the cooling of the fire area.

Figure 7:
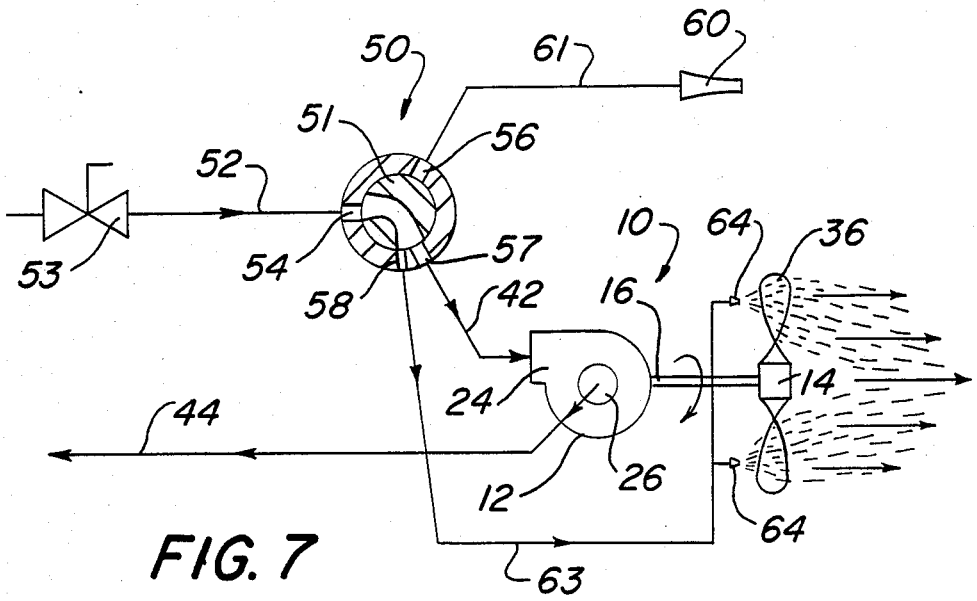

In the FAN and MIST position shown in FIG. 7, valve member 51 of valve 50 is positioned to provide flow communication between inlet 54 and both the outlet ports 57 and 58. In this position, water under pressure is directed through line 42 to operate the turbine 12 and fan 14 as described above with respect to FIG. 6 and also through line 63 to the mist nozzles 64 which direct a small spray of water to the back of fan blades 36. In this position, as shown in FIG. 6, both a small mist of water and a strong clear air stream can be directed onto the fire to both cool the fire and blow smoke away from the fire area by the use of the positive pressure ventilation technique.

Figure 8:
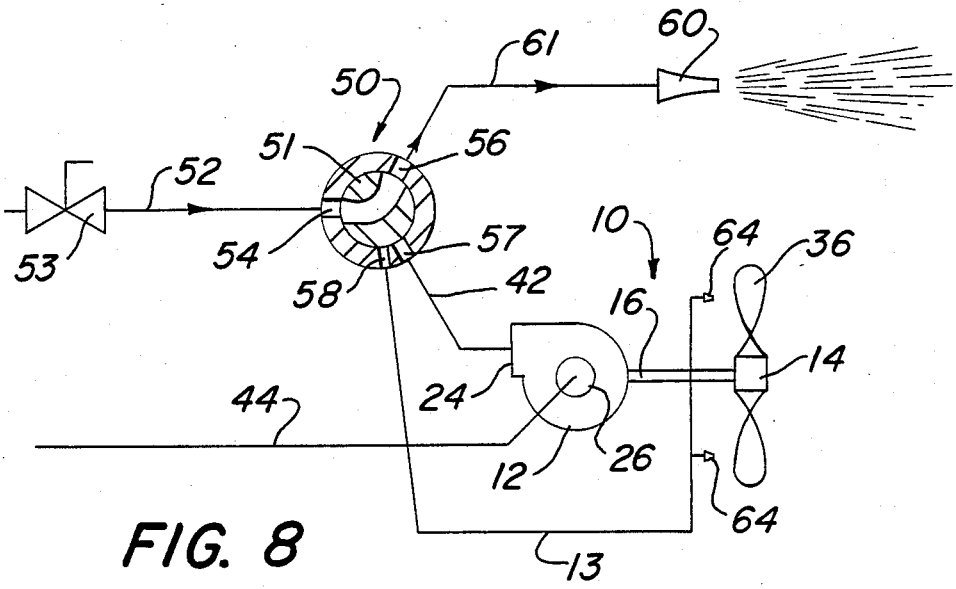

In the NOZZLE position shown in FIG. 8, valve member 51 of valve 50 is positioned to provide flow communication between inlet 54 and outlet port 56. In this position, water under pressure is delivered through line 61 to the nozzle 60 which can be used by the firefighter to direct a straight fire stream onto the fire at a desired time in the firefighting procedure as described.

While there has been show and described what is considered a preferred form of the invention, it will be understood that obvious changes in form can be made without departing from the spirit of the invention and it is therefore intended that the invention be not limited to precise forms herein shown and described and that the invention is to be construed broadly and restricted by the following appended claims. For example, the mist nozzles may be provided with a separate water supply line as shown in the Drawings or may be arranged on the turbine body to receive flow directly from the interior of the turbine and the flow control valve means may include a separate valve for controlling the flow of water supplying the mist nozzles. Furthermore, the fire nozzle 60 may be a separate nozzle as shown in the Drawings or it may be arranged to direct its fire stream from the middle of the fan means 10.

What is claimed is:

1. A water driven fan system for use in positive pressure ventilation in the fighting of fires comprising a portable fan means including shaft means including a fan shaft and a turbine shaft, a fan including a plurality of fan blades mounted on said fan shaft to rotate therewith and to extend radially therefrom, and a water powered turbine for driving said fan including a housing defining an enclosed turbine chamber, and a runner mounted on said turbine shaft to rotate therewith within said turbine chamber, said housing having an inlet and an outlet for directing the water driving said turbine into and out of said turbine chamber, said housing being constructed to direct said water to cause rotation of said runner, means for delivering water under pressure from a pressurized source to said turbine inlet for causing operation of said turbine to drive said fan, said water being discharged from said outlet at a substantial positive pressure, and a flow control valve means for controlling the flow of water from the pressurized source to said turbine inlet, said flow control valve means having an OFF position in which said fan means is inoperative and a FAN position in which water is directed to said turbine inlet for causing operation of said turbine to drive said fan whereby a firefighter can direct a clearstream of air into a structure or toward a fire for fighting the fire by positive pressure ventilation.

2. A fan according to claim 1 including a plurality of spray nozzles constructed and arranged to inject a small spray of water behind said fan blades whereby a mist of water can be directed to the fire area by the firefighter during the fighting of the fire by positive pressure ventilation and means for supplying water from said flow control valve means to said spray nozzles.

3. A fan system according to claim 2 wherein said flow control valve means is selectively movable to a FAN and MIST flow control position wherein water is directed to said turbine inlet to cause operation of said turbine to drive said fan and water is delivered to said spray nozzles so that a small water spray is injected behind said fan blade whereby the firefighter can direct both clear air and a water mist onto a fire for fighting the fire by positive pressure ventilation.

4. A fan system according to claim 1 including a fire nozzle for directing a straight fire stream onto a fire, and means for supplying water from said flow control valve means to said fire nozzle, said flow control valve having an operating position for controlling the flow of water from said pressurized source of said fire nozzle only.

5. A fan system according to claim 3 including a fire nozzle for directing a straight fire stream onto a fire, and means for supplying water from said flow control valve means to said fire nozzle, said flow control valve having an operating position for controlling the flow of water from said pressurized source to said fire nozzle only.

6. A fan system according to claim 1 wherein said fan includes strong, lightweight blades and a shroud-like housing made of spun aluminum, and said turbine includes a body constructed of a cast aluminum.

7. A fan system according to claim 1 wherein said shaft means is constructed and arranged to provide a common drive shaft between said turbine and said fan, said turbine runner being keyed on one end of said shaft and said fan blades being keyed on the other end of said shaft.

8. A fan system according to claim 1 wherein said fan includes a shroud-like housing extending around the outer edges of said fan blades, said shroud being constructed to provide a converging entry portion upstream of said fan blades for accelerating the flow of air entering the fan and a converging exit portion downstream of said fan blades for accelerating the flow of air exiting said fan blades.

9. A fan system according to claim 1 wherein said pressurized source is a fire pump having its suction connected to a supply tank of water and its discharge connected to said turbine inlet by way of a supply hose line, and including a return hose line connecting said turbine outlet back to said supply tank, said positive pressure at said outlet being sufficient to cause the water to flow through said return hose line to said supply tank.

* * * * *